33-243 3R
1/22/85 XR 4,494,313

United States Patent [19]
Scott

[11] Patent Number: 4,494,313
[45] Date of Patent: Jan. 22, 1985

[54] THREE POINT BOW SIGHT

[76] Inventor: Doyce E. Scott, 899 Walnut, Lake Orion, Mich. 48035

[21] Appl. No.: 462,578

[22] Filed: Jan. 31, 1983

[51] Int. Cl.[3] ..... F41G 1/46; F41G 1/10
[52] U.S. Cl. ..... 33/265; 33/243
[58] Field of Search ..... 33/265, 241, 243; 124/87

[56] References Cited

U.S. PATENT DOCUMENTS

| | | | |
|---|---|---|---|
| 846,217 | 3/1907 | King, Jr. | 33/243 |
| 3,865,095 | 2/1975 | Helmick | 33/265 |
| 4,162,579 | 7/1979 | James | 33/265 |
| 4,215,484 | 8/1980 | Lauffenburger | 33/265 |
| 4,215,485 | 8/1980 | Mesler | 33/265 |
| 4,263,718 | 4/1981 | Smith | 33/265 |
| 4,309,827 | 1/1982 | Larson | 33/265 |

FOREIGN PATENT DOCUMENTS

| | | | |
|---|---|---|---|
| 6251 | of 1895 | United Kingdom | 33/243 |

*Primary Examiner*—Richard R. Stearns
*Attorney, Agent, or Firm*—Remy J. VanOphem

[57] ABSTRACT

An archery sighting device which includes an elongated sight bracket fixedly attached to the bow above the hand grip portion. A horizontally disposed tab at the rear of the sight bracket has a "V" notch coplanar with the plane formed by the extended bow string and defines a central sighting point intermediate the bow and the relaxed position of the bow string. A pluraltity of pin sights are disposed at the front end of the sight bracket which define the forward sight point. The plurality of pin sights individually designate preselected shooting distances. The bow string in its extended or drawn position is the third sighting point. Sighting is achieved by the coplanar alignment of the extended bow string with the inverted apex of the "V" notch and the sight pin representing the desired shooting distances.

7 Claims, 5 Drawing Figures

THREE POINT BOW SIGHT

BACKGROUND OF THE INVENTION

The invention is related to archery sight and, in particular, to a three point adjustable sight compensating for different shooting distances to permit accurate shooting of an arrow.

PRIOR ART

Numerous sighting devices have been devised for use on archery bows. One of the disadvantages of the known sighting devices is their difficulty of adjustment so as to compensate for different shooting distances and/or the velocity of the released arrow by the different types of bows. Each archer has his or her own shooting style and therefore each will hold the bow with a different relationship to his or her body as well as with respect to the physical coordinates of the bow. Bow sights of the prior art range from simple markers attached to the bow which are aligned with a grommet attached to the string as taught by Stieber in U.S. Pat. No. 2,574,599 or Roloff, et al., in U.S. Pat. No. 3,389,695. An adjustable front sight is disclosed by Helton in U.S. Pat. No. 3,505,985 and by Smith in U.S. Pat. No. 4,026,032. A multiple piece adjustable sight, is disclosed by James in U.S. Pat. No. 4,162,579. The James sight embodies a multiple pin front sight and a rear sight rigidly attached to the bow. The rear sight extends rearwardly a substantial distance behind the normal relaxed position of the bow string so that it can be positioned in close proximity to the archer's eye when the bow string is drawn back in its extended position. James' front sight includes multiple pins vertically positioned to represent preselected shooting distances. The rear sight is vertically adjustable and is convertible from a "V" notch to a circular aperture commonly known as a "peep" sight. The problem with the James sight is that the rear sight has to be displaced out of the string's return path after it is released otherwise the string will catch on the rear sight and deflect the arrows trajectory. To use this sight, the archer must hold his head in a position different from the standard position where the string is drawn back against his cheek or the corner of his mouth which positions the archer's eye above the arrow's shaft along its desired flight path.

Another type of bow mounted sight is disclosed by Pelsue, U.S. Pat. No. 4,294,222. The Pelsue sight is a pistol type sight for a cross bow having a "V" notch sight at the rear of the pistol outside of the extended position of the bow string. Still another type of bow mounted sight is disclosed by Mesler in U.S. Pat. No. 4,215,485. Mesler's sight includes a "U" shaped bracket attached to the bow with the legs of the bracket protruding transverse to the axis of the arrow. The forward leg of the bracket has three sight apertures representing different shooting ranges. The rear leg, the one closest to the archer, has a single sight aperture. Mesler's sight apertures are sufficiently large to receive the arrow for boresighting purposes. The problem with this sight is that the apertures are too large to give the sight any degree of accuracy and that the forward leg of the bracket obscures a considerable portion of the archer's view of the target. This makes it difficult for the archer to find and isolate the selected target with any speed.

The bow sight described herein is an improvement over the sights disclosed in the prior art, permitting the archer to aim the arrow without changing the position of his head yet giving him an excellent view of the selected target while achieving his aim.

SUMMARY OF THE INVENTION

The invention is a bow mounted three point sight which in its preferred embodiment has a single sight bracket mounted to the bow on the side opposite the arrow rest and extending generally parallel to the axis of the arrow. The forward end of the bracket has at least one vertical slot receiving a plurality of sighting pins. Each of the sighting pins is transversely and vertically adjustable along the vertical slot to represent different shooting ranges. A tab at the rear of the bracket is bent normal to the axis of the arrow inside of the relaxed position of the bow string. A "V" notch is formed in the top surface of the tab with the inverted apex of the "V" being coplanar with the plane defined by the extended bow string. The tips of the sighting pins are transversely adjusted to be coplanar with the plane defined by the extended bow string and the "V" notch.

The advantage of the three point bow sight is that the archer does not have to alter his shooting posture with the eye placed over and sighting parallel to the axis of the arrow. Another advantage of the three point bow sight is that the triple alignment of the bow string with the "V" notch and the sighting pins avoids accidental rotation of the bow about a vertical axis which would otherwise displace the trajectory of the arrow from the sight line path.

These and other advantages of the three point bow sight will become apparent from a reading of the specification in conjunction with the drawings.

DETAILED DESCRIPTION OF THE PREFERRED EMBODIMENT

Figure 1:
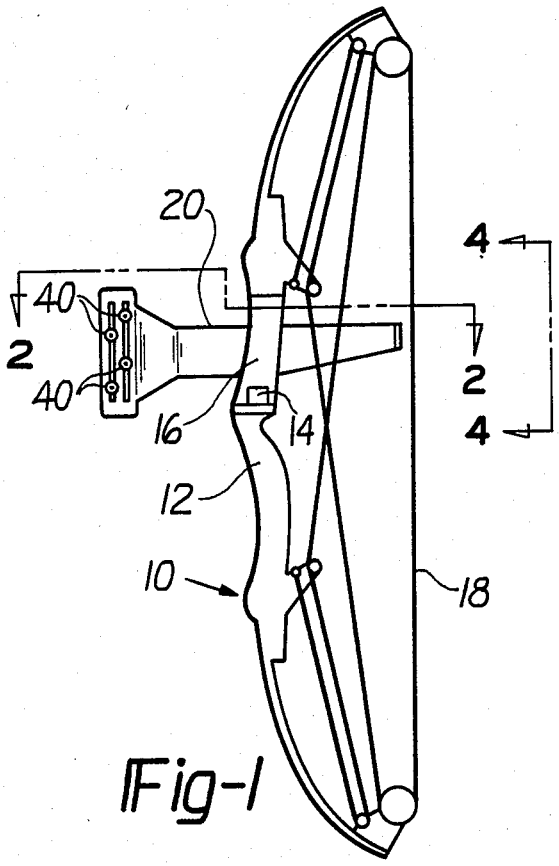
FIG. 1 is a side view of a compound archery bow with the three point bow sight attached.
Figure 2:
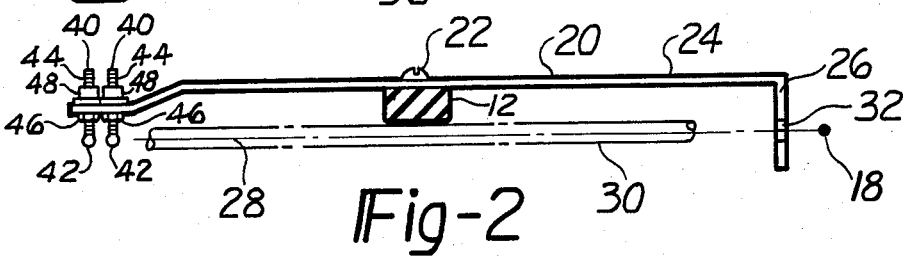
FIG. 2 is an offset cross-sectional view of the three point bow sight taken along lines 2—2 of FIG. 1 illustrating, in phantom, a portion of the arrow shaft.

Referring to FIGS. 1 and 2, there is shown the three point bow sight 20 attached to a conventional compound bow 10 by a pair of fasteners illustrated by screws 22. The structure of the compound bow 10 is well known and includes a central hand grip portion 12, an arrow rest 14, a relief portion 16 above the central hand grip portion 12 and a bow string 18.

The three point bow sight 20 has a sight bracket 24 having a tab 26 bent normal to the axis 28 of an arrow shaft 30 shown in phantom on FIG. 2. Conventionally, the arrow shaft 30 rests on the arrow rest 14 adjacent to the inside surface of the relief portion 16. The tab 26 has a "V" notch 32 formed in its upper surface as more clearly shown in FIG. 4. The inverted apex 34 of the "V" notch 32 is coplanar with the plane formed by the axis 28 of the arrow shaft 30 and the bow string 18. This is the same plane defined by the angularly disposed segments of the bow string 18 when the bow string 18 is in its extended or drawn position.

Figure 3:
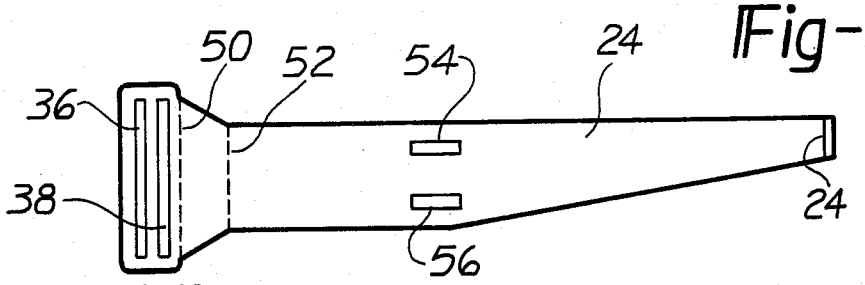
FIG. 3 is a side view of the sight bracket without the pin sights attached.

A plurality of sight pins 40 are attached to the front end of the sight bracket 24 in a pair of slots 36 and 38, as shown more clearly in FIG. 3. As shown in detail in FIG. 2, each of the plurality of sight pins 40 has a bead 42 formed at the end of a threaded shaft 44. The threaded shafts 44 are captivated in the slots 36 and 38 by a threaded position nut 46 on one side of the sight bracket 24 and a threaded locking nut 48 on the other side of the sight bracket. The threaded locking nut 48 has an enlarged collar having a flat face normal to the axis of the threaded shaft 44 and an elongated body portion supporting the plurality of sight pins 40 normal to the surface of the sight bracket 24. The plurality of sight pins 40 are normally attached in the slots 36 and 38 in a staggered relationship permitting them to be positioned closer than would be permitted with a single slot. It is recognized that the sight bracket 24 may only have one slot 36 or 38 if the plurality of sight pins 40 can be positioned apart a distance greater than the diameter of the collars of the threaded locking nut 48.

The slots 36 and 38 permit the plurality of sight pins 40 to be adjusted for different shooting ranges.

The threaded shafts 44 permit the beads 42 to be adjusted laterally so they are coplanar with the plane defined by the axis 28 of the arrow's shaft and the bow string 18. The beads 42 may also be adjusted laterally to compensate for cross winds as is known in the art.

The forward end of the sight bracket 24 is offset inwardly about 0.8 to 1.3 centimeters by a pair of complementary bends in the sight bracket 24 as shown in FIG. 2. The bend locations are illustrated in FIG. 3 by the dashed lines 50 and 52. A pair of mounting slots 54 and 56 are formed intermediate the opposite ends of the sight bracket 24 for attaching the sight bracket 24 to the bow 10. The mounting slots 54 and 56 allow the sight bracket 24 to be adjusted longitudinally so that the tab 26 will not interfere with the bow string 18 in its relaxed position after release of the arrow.

Figure 4:
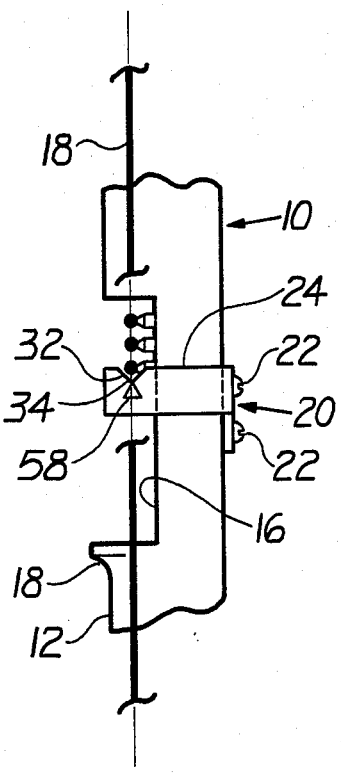
FIG. 4 is a rear view of the bow sight as seen by the archer taken in the direction indicated by lines 4—4 of FIG. 1.

Referring now to FIG. 4, the three point bow sight 20 is shown as viewed by the archer prior to releasing the arrow. The sight bracket 24 and plurality of sight pins 40 are normally a dull black or other dark color to reduce glare and spurious reflections from distracting the archer from his target. When the bow sight is properly aligned, the image of the bow string 18 passes through the center "V" notch 32 and is coincident with the beads 42 of the sight pins. If the bow 10 is inadvertently twisted about its vertical axis by the archer, the alignment of the three sight points will be disturbed indicating a sighting error.

To emphasize the inverted apex 34 of the "V" notch 32 a contrasting color triangle 58 may be disposed in the archer's side of the tab 26 having its apex coincident with the inverted apex 34 of the "V" notch 32. This contrasting color triangle 58 may be painted or printed on the rear surface of the tab 26 or applied by any other means known in the art. Preferably the contrasting color is white but may be any phosphorescent or luminescent color desired by the archer.

Figure 5:
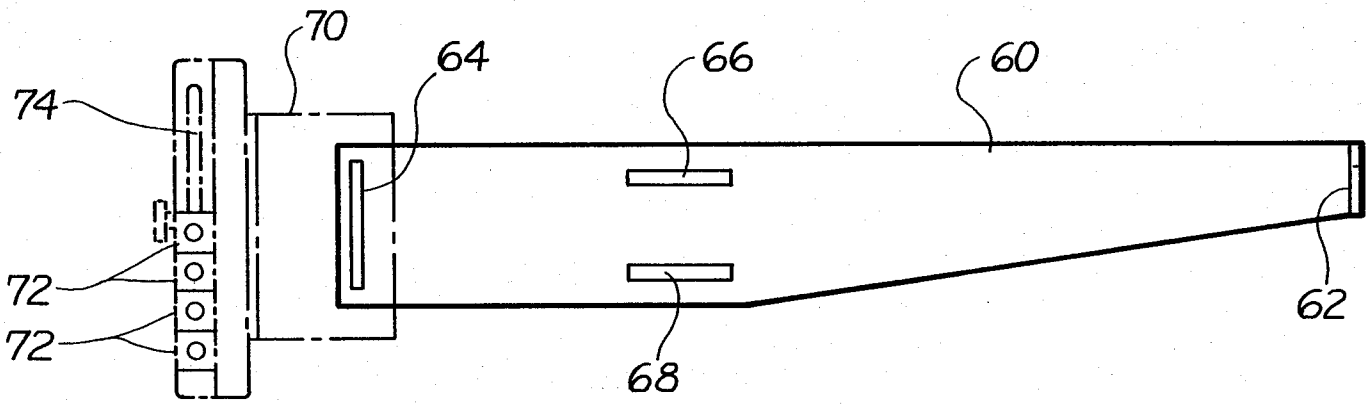
FIG. 5 is a side view of an alternate embodiment of the three point bow sight to which a commercially available pin sight mechanism may be attached.

An alternate embodiment of the three point bow sight is illustrated in FIG. 5. In this embodiment, the forward portion of the sight bracket 24 having slots 36 and 38 is omitted and replaced with a commercially available pin sight mechanism 70 of the type disclosed by Smith in U.S. Pat. No. 4,162,579. Referring to FIG. 5, the alternate configuration of the three point bow sight 20 has a sight bracket 60 having two mounting slots 66 and 68 corresponding to the mounting slots 54 and 56 of the embodiment shown in FIG. 3. A tab 62 is formed at the end of the sight bracket 60 corresponding to the tab 26. The tab 62, in a like manner, has formed in its upper surface a "V" notch 34 as previously described.

A vertical pin sight mounting slot 64 is formed in the forward end of the sight bracket 60 to facilitate the attachment of the pin sight mechanism 70 shown in phantom.

The pin sight mechanisms 70 are commercially available and contain a plurality of sight pins 72 extending in a direction normal to the plane of the sight bracket 60. The plurality of sight pins 72 may be individually positioned along a vertical slot 74 to represent preselected shooting ranges. Functionally, the plurality of sight pins 72 are the same as the plurality of sight pins 40 discussed with reference to the embodiment illustrated in FIG. 2.

It is recognized that a person skilled in the art may make structural changes to the three point bow sight illustrated in the drawings and described above without departing from the spirit of the invention as set forth in the appended claims.

What is claimed is:

1. A three point bow sight for fixed attachment to a bow having a bow string and a hand grip portion, said bow sight comprising:

a horizontally elongated sight bracket having a front end extending forward of said bow, a rear end terminating between said bow and the bow string in its relaxed position and an intermediate portion for fixed connection to said bow;

at least one vertical slot proximate said front end;

a tab formed integral with said horizontally elongated sight bracket, said tab extending normal to said rear end of said horizontally elongated sight bracket in a lateral direction with respect to said bow;

a "V" notch disposed in the top surface of said tab having an apex coplanar with the path defined by said bow string in its extended position; and a plurality of sight pins disposed through said at least one vertical slot, each of said plurality of sight pins being offset vertically with respect to said "V" notch to designate a predetermined shooting range, one end of said plurality of sight pins lying in said plane defined by said bow string in its extended position such that said bow string, said apex of said "V" notch and said one end of said plurality of sight pins define a plane for sighting said bow.

2. The three point bow sight of claim 1 wherein each of said plurality of sight pins has a threaded shaft portion for attaching said plurality of sight pins to said horizontally elongated sight bracket and a bead formed at said one end.

3. The three point bow sight of claim 2 wherein said threaded shaft portions of said plurality of sight pins are disposed through said at least one vertical slot, said bow sight further comprising a like plurality of position nuts, one position nut threadably received on each of said threaded shaft portions in one side of said horizontally elongated sight bracket, and a like plurality of lock nuts, one lock nut threadably received on each of said threaded shaft portions on the other side of said horizontally elongated sight bracket locking said plurality of sight pins in said at least one vertical slot.

4. The three point bow sight of claim 3 wherein said at least one vertical slot is two parrallel vertical slots and wherein said plurality of sight pins are locked in said two parallel vertical slots by said plurality of position nuts and lock nuts in a staggered relationship.

5. The three point bow sight of claim 3 wherein said front end of said horizontally elongated sight bracket is parallel to said intermediate portion and wherein said front end is offset from said intermediate portion in the same direction as said tab by a pair of complementary bends in said horizontal elongated sight bracket.

6. The three point bow sight of claim 5 wherein said front end is offset from said intermediate portion a distance between 0.8 and 1.3 centimeters.

7. The three point bow sight of claim 1, further comprising a contrasting color triangle affixed on the rear surface of said tab, the apex of said contrasting color triangle coincident with the inverted apex of said "V" notch.

* * * * *

UNITED STATES PATENT AND TRADEMARK OFFICE

CERTIFICATE OF CORRECTION

PATENT NO. : 4,494,313

DATED : January 22, 1985

INVENTOR(S) : Doyce E. Scott

It is certified that error appears in the above-identified patent and that said Letters Patent is hereby corrected as shown below:

Column 1, line 5, delete "archery sight" and insert ---- archery sights ----.

Column 3, line 49, delete "the sight pins." and insert ---- the plurality of sight pins 40. ----

Signed and Sealed this

*Thirtieth* Day of *April 1985*

[SEAL]

*Attest:*

DONALD J. QUIGG

*Attesting Officer*

*Acting Commissioner of Patents and Trademarks*